United States Patent [19]

Guittet et al.

[11] Patent Number: 5,013,227

[45] Date of Patent: May 7, 1991

[54] MULTISTAGE ROOTS PUMP AND A METHOD OF ASSEMBLING SUCH A PUMP

[75] Inventors: Dominique Guittet, Annecy; Eric Taberlet; Jean-Francois Vuillermoz, both of Annecy-le-Vieux, all of France

[73] Assignee: Societe Anonyme dite: Alcatel Cit, Paris, France

[21] Appl. No.: 434,044

[22] Filed: Nov. 7, 1989

[30] Foreign Application Priority Data

Nov. 7, 1988 [FR] France ..... 88 14493

[51] Int. Cl.[5] ..... F04C 2/12; F04C 18/12

[52] U.S. Cl. ..... 418/206; 29/888.02; 29/888.023; 403/370; 403/374

[58] Field of Search ..... 418/206, 107, 108, 109, 418/9; 29/888.02, 888.023, 434, 464; 403/355, 318, 370, 374

[56] References Cited

U.S. PATENT DOCUMENTS 4,425,816 1/1984 Toyoda ..... 403/374
4,504,201 3/1985 Wycliffe ..... 418/3
4,789,314 12/1988 Higuchi et al. ..... 418/9

FOREIGN PATENT DOCUMENTS 660528 7/1929 France .

*Primary Examiner*—John J. Vrablik
*Assistant Examiner*—David L. Cavanaugh
*Attorney, Agent, or Firm*—Sughrue, Mion, Zinn, McPeak & Seas

[57] ABSTRACT

The pump comprises a stator constituted by an alternating sucession of stator plates (22) and stator rings (21) defining a sequence of compression chambers (20), and a rotor assembly comprising two shafts (24, 25) each having a compression lobe (28) in each of the compression chambers (20), with the compression lobes being placed on and fixed to their shafts during assembly of the pump, thereby enabling the axial clearance between each lobe and the adjacent stator plate to be individually adjusted, with each lobe being constituted by a body (29) and a clamping plate (30) which is fixed to the body by screws (34) which compress a set of two conical rings (32, 33), one of which (33) penetrates into the other while being compressed radially, thereby fixing the lobe in place. The assembly melthod consists in using a assembly plate (23) having a portion of extra thickness j penetrating into the stator ring over a distance corresponding to the desired clearance between the lobes and the stator plate (22). The lobes are positioned angularly by means of rods (45) and they are positioned axially by thrusting them against the assembly plate (23) by means of assembly screws (48). Once this has been done, the lobes are fixed to their shafts by tightening the clamping screws (34) which compress the conical rings (32, 33) causing them to clamp against the shaft.

3 Claims, 3 Drawing Sheets

MULTISTAGE ROOTS PUMP AND A METHOD OF ASSEMBLING SUCH A PUMP

The present invention relates to a multistage Roots pump comprising a rotor assembly and a stator, the stator defining a plurality of successive compression chambers, each compression chamber being delimited axially by two stator plates, and radially by a stator ring, the rotor assembly being situated inside the stator and being constituted by two parallel shafts, each shaft comprising a compression lobe in each compression chamber, the lobes being placed and fixed on their shafts during assembly of the pump, the shafts being supported by bearings in the stator plates situated at the ends of the stator, and including synchronizing gearing situated in a housing fixed to one of the end stator plates, one of the shafts being driven by a drive motor.

French patent documents 660 528 and 2 517 755 (U.S. Pat. No. 4,504,201) describe a multistage pump of this type.

In patent document 2 517 755, each stage of the stator is constituted by a kind of lidless box which is closed when the next stage is assembled by being juxtaposed therewith, such that each stator stage constitutes a chamber which is delimited axially by a stator plate which is fixed to the stage in question and by a stator plate belonging to the preceding stage. The rotors are mounted on the shafts in a manner which is not specified, but from FIG. 1 it would appear that they are keyed to the shafts.

In patent document 660 528, the stator is shown in FIG. 3 and appears to be a one-piece item, whereas the rotary pistons of the rotors are mounted on the shafts by being keyed thereto.

The object of the invention is to provide a modular multistage Roots pump using parts which are easy to manufacture, which can be machined accurately, and which enable highly accurate assembly to be achieved, in particular for the positions of the rotary lobes on the shafts, thereby obtaining a machine with very small lateral clearances between the lobes and the stator plates, with the clearances being about 5/100 of a millimeter, thereby enabling vacuums to be obtained which are about ten times higher than those that can be obtained using current machines.

The present invention provides a multistage Roots pump of the type defined above, and characterized in that said stator plates and stator rings are separate parts stacked in alternation, and in that each compression lobe is constituted by a body and a clamping plate, the clamping plate being fixed to the body by axially disposed screws and compressing a set of two conical rings, one of which penetrates inside the other while being shrunk radially, thereby fixing the lobe on its shaft.

The invention also provides a method of assembling a Roots pump as defined above, the method being characterized by the following operations in succession:

(a) the two shafts are mounted in an end stator plate and their axial positions are fixed therein;

(b) the synchronizing gearing is mounted on the shafts;

(c) the first stator ring is fixed on the end stator plate and is fixed thereto;

(d) a compression lobe is threaded onto each of the shafts, with the clamping plates being fixed to the lobe bodies, without being clamped thereto;

(e) an assembly plate is put into place by being fixed against the stator ring, said assembly plate having a portion of increased thickness on its inside face within the perimeter delimiting the inside wall of the stator ring, the extra thickness penetrating a distance j into the stator ring and corresponding to the desired axial clearance between the lobes and the stator plate;

(f) the angular positions of the lobes are fixed by means of rods which are threaded into holes provided in the lobes, passing through holes also provided in the said assembly plate;

(g) the lobes are pressed against the assembly plate by means of assembly screws bearing against the assembly plate and having their shanks passing through smooth holes in the assembly plate and screwing into tapped holes in the lobe bodies, and drawing them towards the assembly plate;

(h) the clamping screws are tightened, urging the lobe clamping plates against the lobe bodies and thus axially fixing the lobes on their respective shafts;

(i) the assembly screws for operation (g) are removed;

(j) the positioning rods of operation (f) are removed;

(k) the assembly plate is removed and the following stator plate is put into place; and (l) preceding operations (c) to (k) are repeated cyclically until the last stator plate at the top end of the stator has been put into place.

In a preferred particular implementation, the clamping plate of each compression lobe has four clamping screws for fixing it against the corresponding body during operation (d), with the clamping plate of each lobe being fixed to the corresponding body by only two of these four screws which screws are not tightened, then during operation (g) the two said assembly screws provided with washers bearing against the assembly plate are used and screwed into the two tapped holes in each lobe body that are not occupied by the clamping screws, then during operation (h), the two clamping screws are tightened, after which operation (i) is performed, and then the two remaining clamping screws are put in the places of the removed assembly screws and tightening torque is applied thereto, after which above-mentioned operations (j) and (l) are performed.

The invention will be well understood from the following description of an embodiment made with reference to the accompanying drawings, in which.

Figure 3:
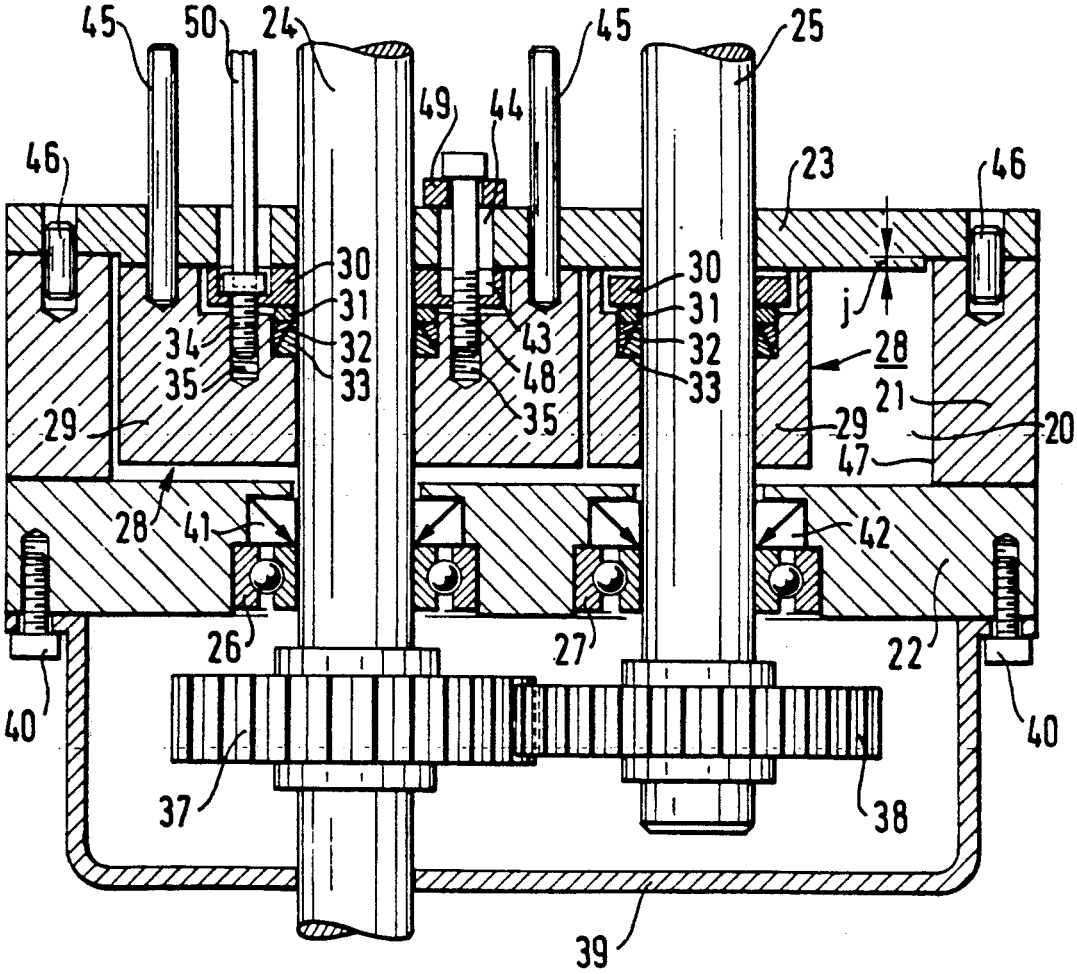
FIG. 3 is a fragmentary view of a pump in accordance with the invention showing the pump while it is being assembled, said view corresponding to a section on line III—III of FIG. 2.
Figure 4:
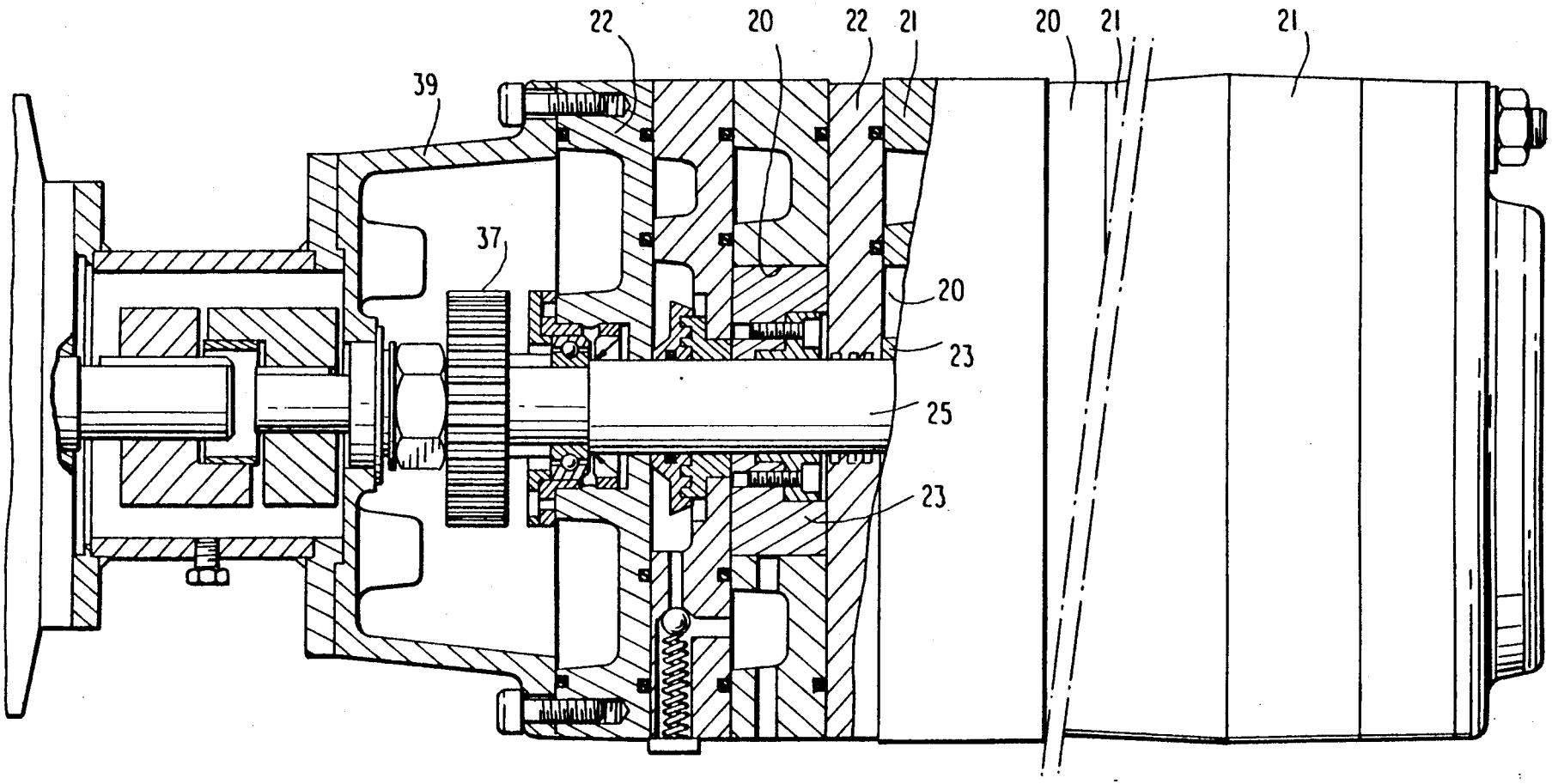
FIG. 4 is a fragmentary view of a pump in accordance with the invention, partially cut away to show the plurality of compression chambers.

With reference to the figures, the Roots pump of the invention comprises a rotor assembly and a stator. The stator defines a plurality of compression chambers, FIG. 4, such as the chamber 20. Each chamber 20 is radially delimited by a stator ring 21 and is axially delimited by two side stator plates separating the chambers from one another. In FIG. 3, only the first stator plate 22 can be seen, which stator plate is the bottom end stator plate. This figure also shows only the first chamber 20 and the first stator ring 21. Thus, after the first stator ring 21 has been put into place, a second stator plate 22 bears against the top end of the stator ring 21. This second stator plate (not shown) has its inside surface at the same level as its bearing surface against the stator ring 21, as shown for the end first stator plate 22. In FIG. 3, the part resting on the top end of the stator ring 21 is not a stator plate 22 but is merely an assembly plate 23 whose function is explained below. The stator is thus constituted by an alternating sequence of stator plates 22 and stator ring 21 up to the stator plate at the top end.

The rotor assembly situated inside the stator comprises two parallel shafts 24 and 25 mounted on ball bearings 26 and 27 carried by the stator plates 22 situated at the ends of the machine.

Within each chamber 20, each of the shafts 24 and 25 is fitted with a compression lobe 28.

The compression lobes 28 are not integral with the shafts 24 and 25 but are fitted onto the shafts and are fixed thereto while the pump is being assembled, thereby enabling axial clearances to be adjusted individually.

Since the compression lobes 28 are all fitted on the shafts during assembly, each of the separation stator plates is constituted by a single piece.

Figure 1:
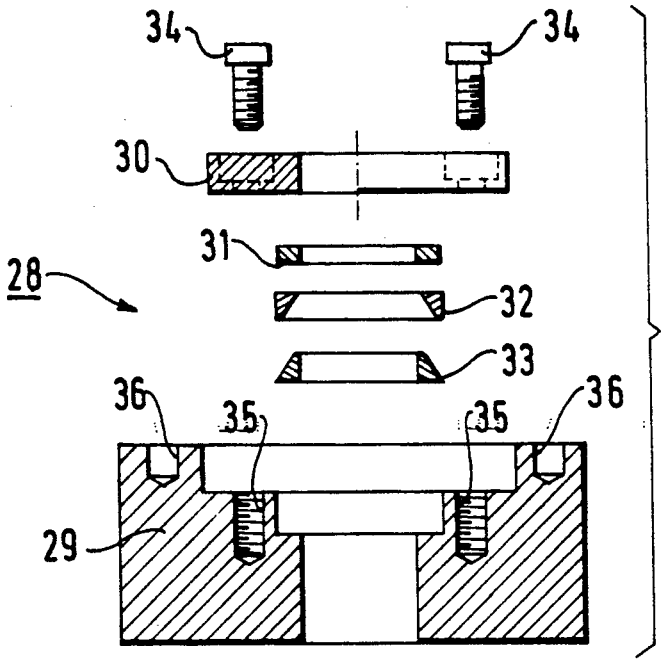
FIG. 1 is an exploded view of a compression lobe of a multistage Roots pump of the invention.

FIG. 1 is an exploded view of a compression lobe 28. It comprises a lobe body 29 and a clamping plate 30. The clamp plate is used to compress a set of two conical rings 32 and 33 by means of a washer 31, thereby fixing the lobe to its shaft. The clamping is performed by means of four clamping screws 34 which pass through smooth holes in the clamping plate 30 and screw into tapped holes 35 in the body 29. The ring 33 penetrates into the ring 32, and while the screws 34 are being tightened, the ring 33 shrinks radially, thereby fixing the lobe 28 on the shaft. The washer 31 and the clamping plate 30 may be constituted by a single part.

Each lobe 28 also has two smooth blind marking holes 36 serving to position the lobes relative to each other during assembly.

Returning to FIG. 3, it can be seen that beyond the end stator plate 22, the shafts include synchronizing gearing constituted by two gear wheels 37 and 38 mounted on the shafts 24 and 25, respectively. This gearing is situated inside a housing 29 fixed by screws 40 to the end stator plate 22. In operation, the housing 39 contains lubricating oil. The compression chambers 20 are isolated from this oil by lip seals 41 and 42. The shaft 24 is rotated by a drive motor (not shown). It should be observed that the compression lobes on each shaft in the various successive chambers are offset from one chamber to the next through an angle of $\pi/2$.

The various stator plates 22 and stator rings 21 are positioned relative to each other by centering pegs and they are fixed to one another by screws. The method of assembling the pump is now described with reference to FIG. 3.

Figure 2:
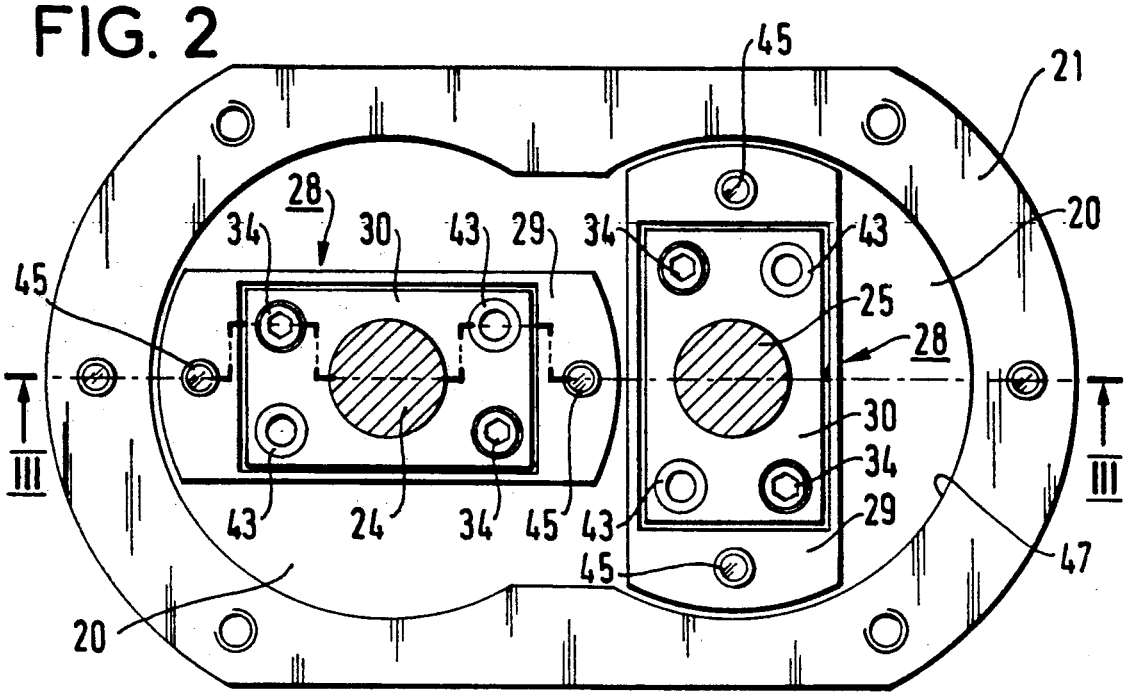
FIG. 2 is a view of a pump in accordance with the invention seen along the axis of the machine and without the separation stator plate, thereby revealing a compression chamber, two lobes, and a stator ring.

To begin with, the shafts 24 and 25 are positioned axially in the end stator plate 22 together with the ball bearings 26 and 27, and the seals 41 and 42. Thereafter the gear wheels 37 and 38 are mounted on the shafts 24 and 25. The first stator ring 21 is then put into position and fixed, after which a compression lobe 28 is threaded onto each shaft. Only two of the four clamping screws 34 are put into place, but no clamping torque is applied. As can be seen in FIG. 2, these two screws 34 are disposed symmetrically on each lobe 29 about the axis of its shaft. FIG. 3 shows only one screw 34, and that screw is in the lefthand lobe. The lobes are angularly positioned "by eye" so that the empty countersunk holes 43 (FIG. 2) in the clamping plates 30 for receiving the clamping screws 34 coincide with the positions that will be taken up by holes 44 provided in the assembly plate 23 when the assembly plate is put into position. This enables positioning rods 45 to be put into place in the marking holes 36 (FIG. 1) of the lobes 28 through holes provided in the assembly plate 23, thereby ensuring that the lobes 28 are accurately positioned and locked into place. The assembly plate 23 is thus put into place and the rods 45 are inserted. The assembly plate 23 is positioned by two pegs 46 and is held against the stator ring 21 by four screws. The inside face of the assembly plate 23 within the perimeter delimiting the inside wall 46 of the stator ring 21 stands proud by an extra thickness j penetrating into the stator ring, which thickness corresponds to the desired axial clearance between the lobes 28 and the stator plate 22 which will be put into place subsequently, and which does not include such an extra thickness. Thereafter, the lobes 28 are pressed against the assembly plate 23 using two assembly screws 48 for each lobe which are screwed into the tapped holes 35 that are not occupied by the clamping screws. These assembly screws 48 bear via thrust washers 49 against the top face of the assembly plate 23. By tightening these two screws 48 in this way, the lobe is pressed against the bottom face of the assembly plate 23.

Thereafter, the two already-positioned clamping screws 34 have the design torque applied to them by means of a screwdriver 50. This has the effect of compressing the two rings 32 and 33, and of clamping them against the shaft 24 (or 25). Thereafter, the assembly screws 48 can be removed and the other two clamping screws 34 can be put into place and tightened.

After which the rods 45 are removed as is the assembly plate 23. A second stator plate 22 is then put into position followed by a second stator ring 21, and the above operations are repeated cyclically until the last stator plate 22 is put into position at the top end.

Once assembly has been completed, the pump is disposed horizontally.

Naturally the pump has an inlet orifice and an outlet orifice, and each chamber has its own intermediate outlet communicating with an intermediate inlet to the following chamber, and this takes place via orifices made through the stator plates 22. However this is conventional, it does not form part of the invention, and is not shown in the drawings.

I claim:

1. A multistage Roots pump comprising a rotor assembly and a stator, the stator defining a plurality of successive compression chambers (20), each compression chamber being delimited axially by two stator plates (22), and radially by a stator ring (21), the rotor assembly being situated inside the stator and being constituted by two parallel shafts (24, 25), each shaft comprising a compression lobe (23) in each compression chamber (20), the lobes being placed and fixed on their shafts during assembly of the pump, the shafts being supported by bearings (26, 27) in the stator plates (22) situated at the ends of the stator, and including synchronizing gearing (37, 38) situated in a housing (39) fixed to one of the end stator plates, one of the shafts (24) being driven by a drive motor, the improvement wherein said stator plates (22) and stator rings (21) are separate parts stacked in alternation, each compression lobe is constituted by a body (29) and a clamping plate (30), the clamping plate being fixed to the body by axially disposed screws (34) and compressing a set of two conical rings (32, 33) interposed axially between said clamping plate and said body, one ring (33) penetrating inside the other (32) with said one ring shrunk radially, and fixing each lobe on its shaft at a defined axial position, thereby enabling a highly accurate assembly to be achieved for the multiple rotary lobes on said shafts at axially defined positions with small lateral clearances between the lobes and the stator plates permitting pump vacuums to be obtained which are approximately ten times higher than those of current machines.

2. A method of assembling a multistage Roots pump comprising a rotor assembly and a stator, the stator defining a plurality of successive compression chambers (20), each compression chamber being delimited axially by two stator plates (22), and radially by a stator ring (21), said rotor assembly being situated inside the stator and being constituted by two parallel shafts (24, 25), each shaft comprising a compression lobe (23) in each compression chamber (20), said method of assembly comprising the following operations in succession:

(a) mounting the two shafts (24, 25) in one end stator plate (22) and fixing their axial positions therein;

(b) mounting the synchronizing gear (37, 38) on the shafts;

(c) fixing a first stator ring (21) on the end stator plate (22);

(d) threading a compression lobe (28) onto each of the shafts, with the clamping plates (30) being fixed to the lobe bodies, without being clamped thereto;

(e) placing an assembly plate (23) into place fixed against a stator ring (21), with the assembly plate having a portion of extra thickness on its inside face within the perimeter delimiting the inside wall of the said first stator ring (21), the extra thickness penetrating a distance j into the stator ring and corresponding to the desired axial clearance between the lobes and the stator plate;

(f) fixing the angular positions of the lobes (38) by means of positioning rods (45) which are threaded into holes (36) provided in the lobes, passing through holes also provided in said assembly plate;

(g) pressing the lobes against the assembly plate (23) by means of assembly screws (48) bearing against the assembly plate and having their shanks passing through smooth holes (44) in the assembly plate and screwing into tapped holes (35) in the lobe bodies, and drawing them towards the assembly plate (23);

(h) tightening the clamping screws (34), urging the lobe clamping plates against the lobe bodies and thus axially fixing the lobes (28) on their respective shafts (24, 25) at defined axial positions;

(i) removing the assembly screws (48) for operation (g);

(j) removing the positioning rods (45) of operation (f);

(k) removing the assembly plate (23) and putting into place the succeeding stator plate (22); and (l) repeating the preceding operations (c) to (k) cyclically until the last stator plate (22) at a top end of the stator has been put into place.

3. A method according to claim 2, characterized in that the clamping plate (30) of each compression lobe (28) has four clamping screws (34) for fixing it against the corresponding body (29) during operation (d) of claim 2, with the clamping plate of each lobe being fixed to the corresponding body by only two of these four screws (34) which screws are not tightened, in that during operation (g) the two said assembly screws (48) provided with washers (49) bearing against the assembly plate are used and screwed into the two tapped holes (35) in each lobe body that are not occupied by the clamping screws (34), in that during operation (h), the two clamping screws (34) are tightened, after which operation (i) is performed, and then the two remaining clamping screws (34) are put in the places of the removed assembly screws (48) and tightening torque is applied thereto, after which operations (j) and (l) are performed.

* * * * *